US008808009B2

(12) United States Patent
Mason et al.

(10) Patent No.: US 8,808,009 B2
(45) Date of Patent: Aug. 19, 2014

(54) ELECTRICAL INTERCONNECT DEVICE

(75) Inventors: Jeffery W. Mason, North Attleboro, MA (US); Wayne Alden, III, Whitman, MA (US)

(73) Assignee: Tyco Electronics Corporation, Berwyn, PA (US)

( * ) Notice: Subject to any disclaimer, the term of this patent is extended or adjusted under 35 U.S.C. 154(b) by 101 days.

(21) Appl. No.: 13/437,546

(22) Filed: Apr. 2, 2012

(65) Prior Publication Data

US 2013/0260578 A1 Oct. 3, 2013

(51) Int. Cl.
*H01R 12/00* (2006.01)

(52) U.S. Cl.
USPC ..... 439/66; 439/71

(58) Field of Classification Search
USPC ..... 439/66, 70, 71
See application file for complete search history.

(56) References Cited

U.S. PATENT DOCUMENTS 5,604,445 A * 2/1997 Desai et al. ..... 324/750.03
6,358,063 B1 * 3/2002 Neidich ..... 439/66
6,733,304 B1 * 5/2004 Liao ..... 439/66
6,811,408 B2 * 11/2004 Achammer et al. ..... 439/66
7,682,160 B2 * 3/2010 Liao ..... 439/71
7,762,819 B2 * 7/2010 Mori et al. ..... 439/66
7,775,803 B2 * 8/2010 Gillespie et al. ..... 439/66
7,980,861 B2 * 7/2011 Tamura ..... 439/66
8,087,941 B2 * 1/2012 Liao et al. ..... 439/66
8,287,289 B2 * 10/2012 Niitsu et al. ..... 439/66
8,333,597 B2 * 12/2012 Tamura ..... 439/66

* cited by examiner

*Primary Examiner* — Thanh Tam Le

(57) ABSTRACT

An interconnect device for electrically connecting first and second electrical components together along a connection axis includes a contact assembly having an insulative carrier and electrical contacts held by the insulative carrier. The electrical contacts include mounting segments and mating segments. The mating segments are configured to be compressed along the connection axis. A frame includes a central opening and at least one perimeter segment that defines a boundary of the central opening. The contact assembly is held within the central opening. The frame includes a compression stop having a stop surface that is configured to engage the second electrical component to limit an amount of compression of the mating segments along the connection axis. The stop surface is aligned with a mating side surface of the perimeter segment.

20 Claims, 3 Drawing Sheets

ELECTRICAL INTERCONNECT DEVICE

BACKGROUND OF THE INVENTION

The subject matter described and/or illustrated herein relates generally to electrical interconnect devices for use between opposed arrays of contacts.

Interconnect devices are used to provide electrical connection between two or more opposing arrays of contacts for establishing at least one electrical circuit, where the respective arrays may be provided on a device, printed circuit board, Pin Grid Array (PGA), Land Grid Array (LGA), Ball Grid Array (BGA), and the like. In one interconnect technique, the electrical connection is provided by an interconnect device that is physically interposed between corresponding electrical contacts of the opposing arrays of contacts. At least some known interconnect devices use an array of elastomeric columns supported on a substrate. The elastomeric columns may be compressed to establish reliable contact between the opposing contacts. In some known interconnect devices, the elastomeric columns are conductive and provide the electrical connection.

In known interconnect devices using conductive elastomeric columns, the elastomeric columns are held by an insulative carrier having coverlays provided on both sides of the insulative carrier. The coverlays protect the elastomeric columns and provide mechanical stops for interfacing with the two electrical components connected by the interconnect device. For example, the coverlays may protect the elastomeric columns from mechanical and/or electrical failure resulting from over-compression of the elastomeric columns. But, the coverlays are extra layers of the interconnect device that add to the cost and complexity of the interconnect device.

A need remains for a less costly and/or complex electrical interconnect device.

BRIEF DESCRIPTION OF THE INVENTION

In one embodiment, an interconnect device is provided for electrically connecting first and second electrical components together along a connection axis. The interconnect device includes a contact assembly having an insulative carrier and electrical contacts held by the insulative carrier. The insulative carrier includes opposite mating and mounting sides. The electrical contacts include mounting segments that extend along the mounting side of the insulative carrier for mounting to the first electrical component. The electrical contacts include mating segments that extend along the mating side of the insulative carrier for mating with the second electrical component. The mating segments are configured to be compressed along the connection axis. A frame is configured to be mounted to the first electrical component. The frame includes a central opening and at least one perimeter segment that defines a boundary of the central opening. The contact assembly is held within the central opening. The at least one perimeter segment includes a mounting side surface that is configured to face the first electrical component and a mating side surface that is opposite the mounting side surface. The frame includes a compression stop having a stop surface that is configured to engage the second electrical component to limit an amount of compression of the mating segments along the connection axis. The stop surface is aligned with the mating side surface of the perimeter segment.

In another embodiment, an interconnect device is provided for electrically connecting first and second electrical components together along a connection axis. The interconnect device includes a contact assembly having an insulative carrier and electrical contacts held by the insulative carrier. The insulative carrier includes opposite mating and mounting sides. The electrical contacts include mounting segments that extend along the mounting side of the insulative carrier for mounting to the first electrical component. The electrical contacts include mating segments that extend along the mating side of the insulative carrier for mating with the second electrical component. A frame is configured to be mounted to the first electrical component. The frame includes a central opening and a perimeter segment that defines a boundary of the central opening. The frame includes upper and lower tabs that extend from the perimeter segment into the central opening. The upper tab is spaced apart from the lower tab along the connection axis. At least one of the upper tab and the lower tab is resiliently deflectable. The contact assembly is held by the frame within the central opening such that an edge segment of the insulative carrier is captured between the upper and lower tabs with a snap-fit connection.

In another embodiment, an interconnect device for electrically connecting first and second electrical components together along a connection axis. The interconnect device includes a contact assembly having an insulative carrier and electrical contacts held by the insulative carrier. The insulative carrier includes opposite mating and mounting sides. The electrical contacts include mounting segments that extend along the mounting side of the insulative carrier for mounting to the first electrical component. The electrical contacts include mating segments that extend along the mating side of the insulative carrier for mating with the second electrical component. The mating segments are configured to be compressed along the connection axis. A frame is configured to be mounted to the first electrical component. The frame includes a central opening and at least one perimeter segment that defines a boundary of the central opening. The contact assembly is held within the central opening. The frame includes a tab that extends from the perimeter segment into the central opening and over an edge segment of the mating side of the insulative carrier. The tab includes a compression stop having a stop surface that is configured to engage the second electrical component to limit an amount of compression of the mating segments along the connection axis.

DETAILED DESCRIPTION OF THE INVENTION

Figure 1:
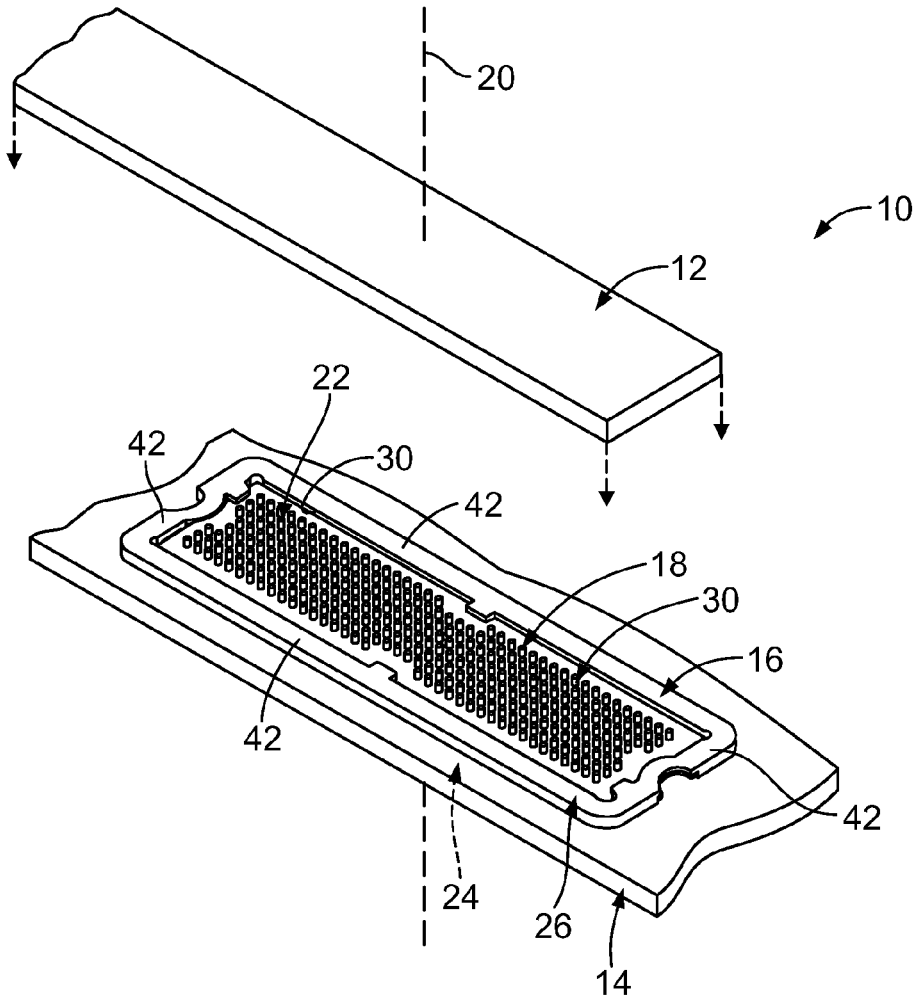
FIG. 1 is a partially exploded perspective view of an exemplary embodiment of an electrical interconnect system.

FIG. 1 is a partially exploded perspective view of an exemplary embodiment of an electrical interconnect system 10. The system 10 includes an electrical component 12, an electrical component 14, and an interconnect device 16 therebetween. The interconnect device 16 is illustrated mounted to the electrical component 14. The electrical component 12 is illustrated poised for mating with the interconnect device 16. The electrical components 12 and 14 both have an array of contacts, such as land grid arrays, ball grid arrays, and/or the like that are electrically connected together by the interconnect device 16. Each of the electrical components 12 and 14 may be referred to herein as a "first" and/or a "second" electrical component.

In the illustrated embodiment, the electrical component 12 is a flex circuit and the electrical component 14 is a circuit board. But, the electrical components 12 and 14 are each not limited thereto. Rather, each of the electrical components 12 and 14 may be any type of electrical component, such as, but not limited to, an electronic package (such as, but not limited to, a chip, a processor, an integrated circuit, and/or the like), a circuit board, a flex circuit, and/or the like. In some embodiments, the electrical components 12 and 14 are both circuit boards.

The interconnect device 16 includes a contact assembly 18 that is used to electrically connect the electrical components 12 and 14 along a connection axis 20. For example, the contact assembly 18 is configured to engage the arrays of contacts of the electrical components 12 and 14. The contact assembly 18 has a mating side 22 and an opposite mounting side 24. The interconnect device 16 is configured to be electrically connected to the electrical component 12 along the mating side 22. The interconnect device 16 is configured to be electrically connected to the electrical component 14 along the mounting side 24.

The interconnect device 16 includes a frame 26 having a plurality of perimeter segments 42 that define a central opening 30. The frame 26 is configured to be mounted to the electrical component 14, such as, but not limited to, using latches, fasteners, threaded fasteners, and/or the like. The contact assembly 18 is held within the central opening 30 of the frame 26 such that the contact assembly 18 interconnects the electrical components 12 and 14. In an exemplary embodiment, the contact assembly 18 is removable from the frame 26 such that the contact assembly 18 may be removed and replaced while leaving the frame 26 attached to the electrical component 14.

Figure 2:
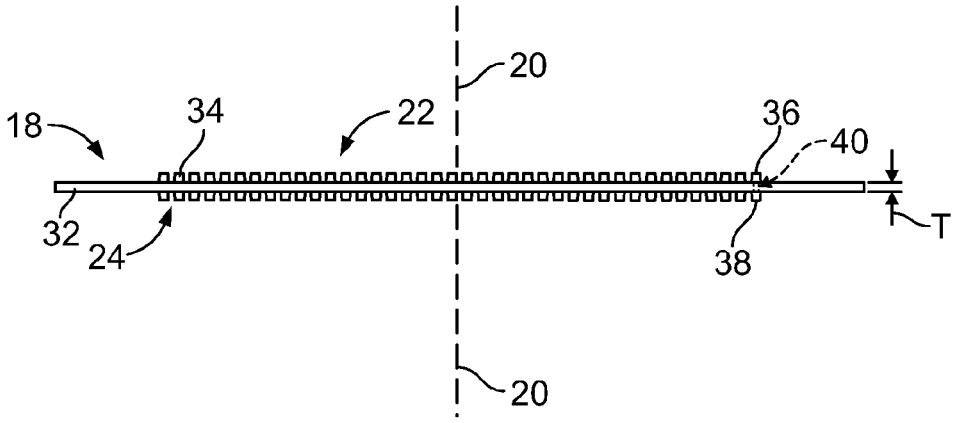
FIG. 2 is a side elevational view of an exemplary embodiment of a contact assembly of the electrical interconnect system shown in FIG. 1.

FIG. 2 is a side elevational view of the contact assembly 18. The contact assembly 18 includes an insulative carrier 32 holding an array of elastomeric columns 34. The insulative carrier 32 may have one or more layers. The insulative carrier 32 extends between the mating side 22 and the mounting side 24. The insulative carrier 32 is fabricated from an insulative material, such as, but not limited to, a polyimide material that may be arranged as a polyimide film (e.g., a Kapton® material). Optionally, one or more outer layers, such as a coverlay (not shown) and a bonding layer (not shown) may be applied to the mating side 22 and/or the mounting side 24.

Figure 5:
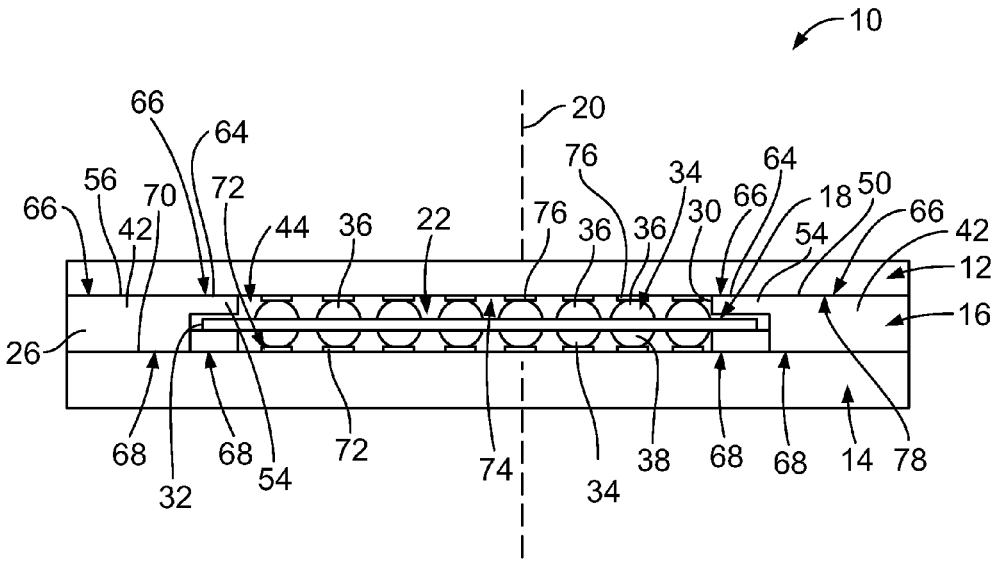
FIG. 5 is a cross-sectional view of the electrical interconnect system shown in FIG. 1.

The elastomeric columns 34 are arranged in an array having a predetermined pattern or layout that corresponds to the array of contacts of the electrical component 12 and the electrical component 14. The elastomeric columns 34 extend outward along both the mating side 22 and the mounting side 24. Specifically, the elastomeric columns 34 include mating segments 36 that extend along the mating side 22 and mounting segments 38 that extend along the mounting side 24. In an exemplary embodiment, the mating segments 36 and the mounting segments 38 are frustoconically shaped, being wider about the base and narrower at the tips. In an exemplary embodiment, the elastomeric columns 34 are conductive elastomeric columns, such as, but not limited to, columns fabricated from a mixture of an elastic material and electrically conductive particles (e.g., flakes, spheres, and/or the like). The elastomeric columns 34 provide conductive paths between the arrays of contacts of the electrical components 12 and 14 (FIGS. 1 and 5). The elastomeric columns 34 may be referred to herein as "electrical contacts".

The elastomeric columns 34 are at least partially compressible along the connection axis 20. For example, the mating segments 36 may at least partially compress along the connection axis 20 when the electrical component 12 is mated with the interconnect device 16 and/or when the interconnect device 16 is mounted to the electrical component 14. Moreover, and for example, the mounting segments 38 may at least partially compress along the connection axis 20 when the interconnect device 16 is mounted to the electrical component 14 and/or when the electrical component 12 is mated with the interconnect device 16.

In the illustrated embodiment, the elastomeric columns 34 extend through a thickness T of the insulative carrier 32 such that each elastomeric column 34 includes both a mating segment 36 and the corresponding mounting segment 38. Accordingly, in the illustrated embodiment, the mid-sections 40 of the elastomeric columns 34 are held by, and extend within, the thickness T of the insulative carrier 32. In other embodiments, each mounting segment 38 is a discrete component (e.g., a discrete electrical contact) from the corresponding mating segment 36. In such embodiments, corresponding mating and mounting segments 36 and 38, respectively, are electrically connected together through at least one intervening electrically conductive structure (not shown), such as, but not limited to, an electrical via, an electrical contact, a trace or other circuit pathway, and/or the like.

Figure 3:
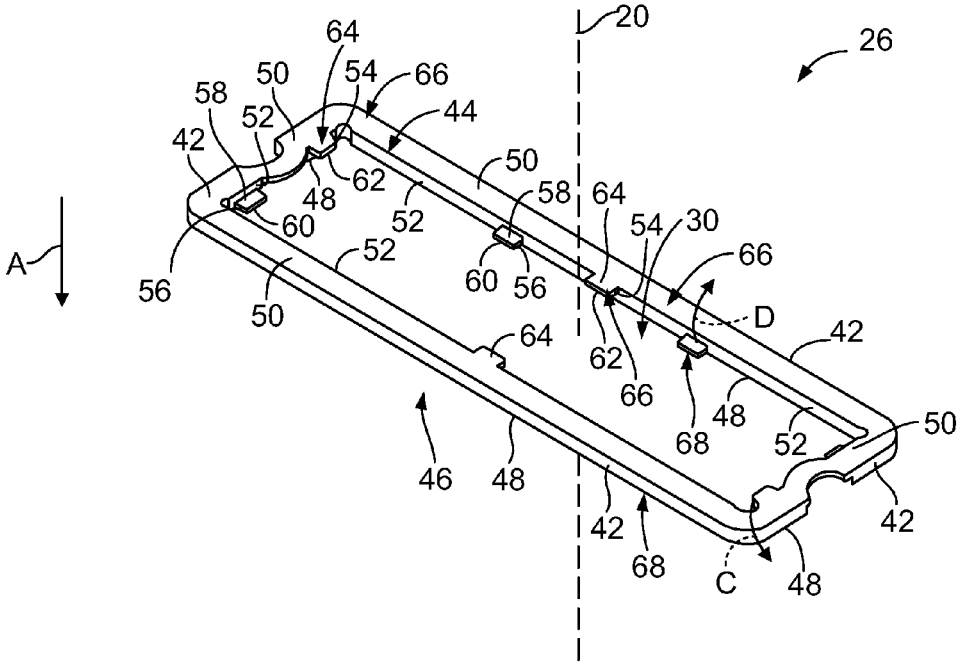
FIG. 3 is a top perspective view of an exemplary embodiment of a frame of the electrical interconnect system shown in FIG. 1.

FIG. 3 is a top perspective view of an exemplary embodiment of the frame 26. In the illustrated embodiment, the frame 26 includes four perimeter segments 42 that define boundaries of a generally rectangular-shaped central opening 30. Any number of perimeter segments 42 may be provided in alternative embodiments, defining a central opening 30 having any shape. In the illustrated embodiment, all of the perimeter segments 42 are connected defining a one-piece, unitary frame 26. In alternative embodiments, the frame 26 may be defined by separate and discrete frame pieces that define one or more of the perimeter segments 42. For example, two right angle frame pieces may cooperate to define the central opening 30, where the individual frame pieces are separately mounted to the electrical component 14 (FIGS. 1 and 5). Other configurations are possible in alternative embodiments.

In an exemplary embodiment, the frame 26 has an open top 44 and an open bottom 46. The central opening 30 extends along the connection axis 20 between the open top 44 and the open bottom 46. The contact assembly 18 (FIGS. 1, 2, and 4) may be loaded into the central opening 30 through the open top 44 or through the open bottom 46. The contact assembly 18 is positioned in the central opening 30 such that the contact assembly 18 engages the array of contacts of the electrical component 12 (FIGS. 1 and 5) through the open top 44 and engages the array of contacts of the electrical component 14 through the open bottom 46.

The perimeter segments 42 includes mounting side surfaces 48 and opposite mating side surfaces 50. The mounting side surfaces 48 are configured to face, and/or engage, the electrical component 14 when the frame 26 is mounted to the electrical component 14. The perimeter segments 42 include interior side surfaces 52.

The frame 26 includes one or more upper tabs 54 and one or more lower tabs 56 that extend into the central opening 30.

Specifically, the upper and lower tabs 54 and 56, respectively, extend from the interior side surfaces 52 of one or more corresponding perimeter segments 42 into the central opening 30. The upper and lower tabs 54 and 56, respectively, are used to hold the contact assembly 18 within the central opening 30. In the illustrated embodiment, the upper tabs 54 are offset from the lower tabs 56 along the lengths of the perimeter segments 42. In alternative embodiments, one or more upper tabs 54 may be aligned along the length of the corresponding perimeter segment 42 with a corresponding lower tab 56 such that the corresponding tabs 54 and 56 oppose each other.

Each lower tab 56 has an upward facing ledge 58 and a mounting side surface 60 that extends opposite the upward facing ledge 58. Each upper tab 54 has a downward facing ledge 62 and a mating side surface 64 that extends opposite the downward facing ledge 62. The upper and lower tabs 54 and 56, respectively, are spaced apart from each other along the connection axis 20. In other words, the upper tabs 54 are spaced vertically above the lower tabs 56 such that a gap or space is created between the upward facing ledge 58 and downward facing ledge 62. The gap or space accommodates the thickness T (FIG. 2) of the insulative carrier 32 (FIG. 2) of the contact assembly 18, as will be described below. In the illustrated embodiment, the mating side surfaces 64 of the upper tabs 54 are aligned along the connection axis 20 with the mating side surfaces 50 of the perimeter segments 42. In alternative embodiments, the mating side surfaces 64 of the upper tabs 54 are offset along the connection axis 20 from the mating side surfaces 50 in the direction of the arrow A in FIG. 3.

In an exemplary embodiment, the upper tabs 54 and/or the lower tabs 56 are resiliently deflectable to enable the frame 26 to hold the contact assembly 18 with a snap-fit connection. Specifically, in an exemplary embodiment, both the upper tabs 54 and the lower tabs 56 are resiliently deflectable in the directions of the arcs C and D, respectively. The tabs 54 and/or 56 can be deflected along the respective arcs C and D to enable edge segments 63 (FIG. 4) of the insulative carrier 32 to clear the tabs 54 and/or 56 and fit within the gap or space between the upward facing ledge 58 and the downward facing ledge 62, as will be described below. The tabs 54 and/or 56 may be resiliently deflectable along any other arcs besides the respective arcs C and D that enable the tabs 54 and/or 56 to connect to the insulative carrier 32 with a snap-fit connection.

The frame 26 may includes any number of the upper tabs 54 and any number of the lower tabs 56. Moreover, each perimeter segment 42 may include any number of the upper tabs 54 and any number of the lower tabs 56. The upper and lower tabs 54 and 56, respectively, may each have any size and/or shape that enables the tabs 54 and 56 to function as described and/or illustrated herein.

The frame 26 includes one or more compression stops 66 and/or includes one or more compression stops 68. The compression stops 66 include stop surfaces that are configured to engage the electrical component 12 to limit an amount of compression of the mating segments 36 (FIGS. 2 and 5) of the elastomeric columns 34 along the connection axis 20 as the electrical component 12 is mated with the contact assembly 18, as will be described below. Optionally, the stop surfaces of the compression stop 66 are aligned along the connection axis 20 with the mating side surfaces 50 of the perimeter segments 42. In some embodiments, one or more of the perimeter segments 42 includes one or more of the compression stops 66. Specifically, the mating side surface 50 of one or more of the perimeter segments 42 may define the stop surface of one or more compression stops 66. Moreover, in some embodiments, one or more of the upper tabs 54 includes one or more of the compression stops 66. Specifically, the mating side surface 64 of one or more of the upper tabs 54 may define the stop surface of one or more compression stops 66. In the illustrated embodiment, the stop surface of one or more compression stops 66 is defined by a combination of the mating side surface 50 of a perimeter segment 42 and the mating side surface 64 of an upper tab 54. Each of the compression stops 66 may be referred to herein as a "mating side stop". Each of the compression stops 68 may be referred to herein as a "mounting side stop".

The compression stops 68 include stop surfaces that are configured to engage the electrical component 14 to limit an amount of compression of the mating segments 36 and/or the mounting segments 38 (FIGS. 2 and 5) of the elastomeric columns 34 along the connection axis 20 as the electrical component 12 is mated with the contact assembly 18 and/or as the interconnect device 16 is mounted to the electrical component 14. In some embodiments, one or more of the perimeter segments 42 includes one or more of the compression stops 66. Specifically, the mounting side surface 48 of one or more of the perimeter segments 42 may define the stop surface of one or more compression stops 68. Moreover, in some embodiments, one or more of the lower tabs 56 includes one or more of the compression stops 68. Specifically, the mounting side surface 60 of one or more of the lower tabs 56 may define the stop surface of one or more compression stops 68. In some embodiments, the stop surface of one or more compression stops 68 is defined by a combination of the mounting side surface 48 of a perimeter segment 42 and the mounting side surface 60 of a lower tab 56.

Figure 4:
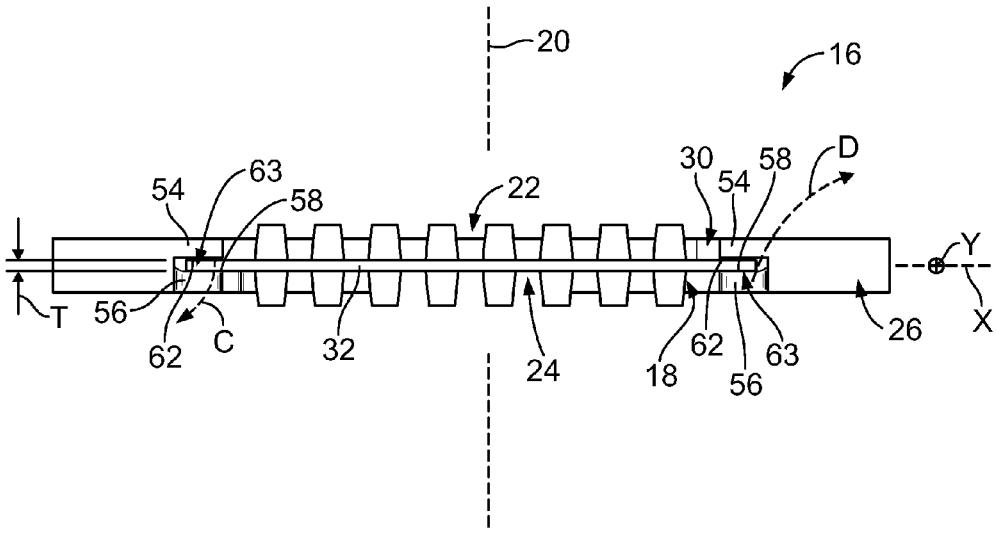
FIG. 4 is a cross-sectional view of an exemplary embodiment of an interconnect device illustrating the contact assembly shown in FIG. 2 held by the frame shown in FIG. 3.

FIG. 4 is a cross-sectional view of the interconnect device 16 illustrating the contact assembly 18 held by the frame 26. The contact assembly 18 is received in the central opening 30 of the frame 26 such that the edge segments 63 of the insulative carrier 32 are received, or captured, between the upper and lower tabs 54 and 56, respectively. The mounting side 24 of the insulative carrier 32 faces, and/or engages, the upward facing ledges 58 of the lower tabs 56, while the mating side 22 of the insulative carrier faces, and/or engages, the downward facing ledges 62 of the upper tabs 54. The upper tabs 54 extend over the edge segments 63 of the insulative carrier 32 along the mating side 22, and the lower tabs 56 extend over the edge segments 63 along the mounting side 24 of the insulative carrier 32.

As described above, the contact assembly 18, and more specifically, the insulative carrier 32 is held by the frame 26 with a snap-fit connection. For example, the upper tabs 54 and/or the lower tabs 56 have been deflected along the respective arcs C and D to enable the edge segments 63 of the insulative carrier 32 to clear the tabs 54 and/or 56 and fit within the gap or space between the upward facing ledge 58 and the downward facing ledge 62. The resilience of the tabs 54 and/or 56 causes the tabs 54 and/or 56 to snap back from the deflected position to the position shown in FIG. 4. Accordingly, the edge segments 63 of the insulative carrier 32 are captured between the upper tabs 54 and the lower tabs 56 with a snap-fit connection.

In the illustrated embodiment, the gap or space between the ledges 58 and 62 is sized similarly to the thickness T of the insulative carrier 32 such that the edge segments 63 of the insulative carrier 32 are held between the upper and lower tabs 54 and 56, respectively, with a relatively tight fit. In alternative embodiments, the gap or space between the ledges 58 and 62 has a greater dimension than the thickness T of the insulative carrier 32 such that the edge segments 63 of the insulative carrier 32, and thus the contact assembly 18, can float within the gap or space along the connection axis 20. Optionally, the insulative carrier 32 can float relative to the frame 26 along one or more axes (e.g., the X and Y axes shown in FIG. 4) that extend approximately perpendicular to the connection axis 20.

FIG. 5 is a cross-sectional view of the electrical interconnect system 10 illustrating the interconnect device 16 connected between the electrical components 12 and 14. The frame 26 is mounted to a mounting surface 70 of the electrical component 14 above an array of component contacts 72 of the electrical component 14. The frame 26 is configured to be mounted to the electrical component 14 using any structure, means, and/or the like, such as, but not limited to, using latches, fasteners, threaded fasteners, and/or the like. The stop surfaces of the compression stops 68 engage the electrical component 14 to limit the amount of compression of the mounting segments 38 of the elastomeric columns 34 along the connection axis 20.

The contact assembly 18 is connected to the frame 26 before or after the frame 26 is mounted to the electrical component 14. For example, the contact assembly 18 may be loaded into the central opening 30 of the frame 26 through the open top 44 after the frame 26 is mounted to the electrical component 14. Alternatively, prior to mounting the frame 26 to the electrical component 14, the contact assembly 18 may be connected to the frame 26 and the interconnect device 16 can be mounted to the electrical component 14 as a unit.

When mated, the electrical component 12 is loaded onto the mating side 22 of the contact assembly 18. A mating interface 74 of the electrical component 12 engages the contact assembly 18. The electrical component 12 includes an array of component contacts 76 at the mating interface 74. The component contacts 76 engage corresponding mating segments 36 of the elastomeric columns 34.

The electrical component 12 is loaded onto the mating side 22 of the contact assembly 18 until the electrical component 12 engages the stop surfaces of the compression stops 66. The compression stops 66 limit the amount of compression of the elastomeric columns 34. For example, the compression stops 66 limit the amount of compression of the mating segments 36 along the connection axis 20. The compression stops 66 and/or 68 facilitate preventing damage to the elastomeric columns 34 from over-compression of the elastomeric columns 34, which may facilitate protecting the elastomeric columns from mechanically and/or electrically failing by being over-stressed. Because the compression stops 66 and/or 68 provide mechanical stops for interfacing with the electrical components connected by the interconnect device 16, the contact assembly 18 can be used without one or more coverlays over the insulative carrier 32. As such, the contact assembly 18 may be less complex and/or less costly to manufacture than a contact assembly 18 that includes a coverlay. For example, the material cost of the contact assembly 18 may be reduced, as well as assembly cost of the contact assembly 18.

In the illustrated embodiment, the stop surface of each of the compression stops 66 is defined by a combination of the mating side surfaces 50 of the perimeter segments 42 and the mating side surfaces 64 of the upper tabs 54. Specifically, as is shown in FIG. 5, a mating side 78 of the electrical component 12 is engaged with the mating side surfaces 50 and 64. Accordingly, the compression stops 66 are defined by both the perimeter segments 42 and the upper tabs 54 in the embodiment illustrated in FIG. 5.

Figure 6:
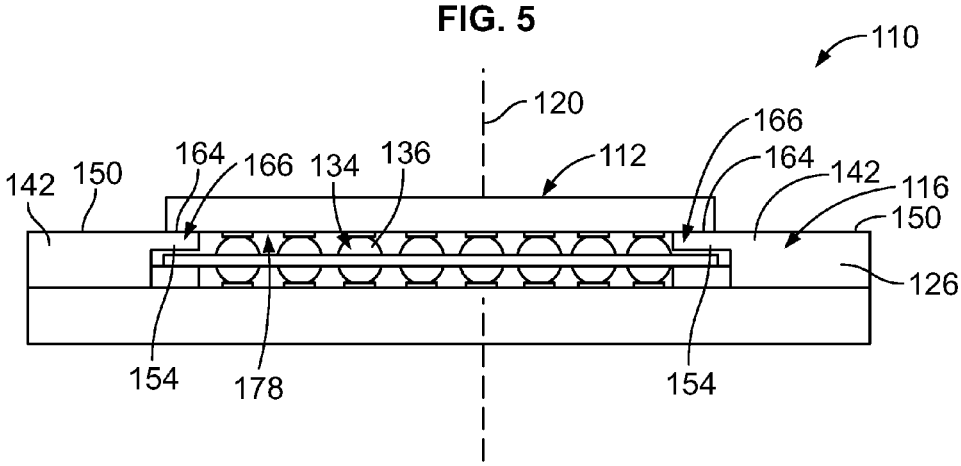
FIG. 6 is a cross-sectional view of another exemplary embodiment of an electrical interconnect system.

FIG. 6 illustrates an alternative embodiment of an electrical interconnect system 110 wherein only upper tabs 154 of a frame 126 of an interconnect device 116 define compression stops 166. In other words, perimeter segments 142 of the frame 126 do not include compression stops 166 in the embodiment illustrated in FIG. 6. Rather, the mating side 178 of an electrical component 112 is engaged with mating side surfaces 164 of the upper tabs 154 but is not engaged with mating side surfaces 150 of the perimeter segments 142. Engagement between the mating side 178 of the electrical component 112 and the mating side surfaces 164 of the upper tabs 154 limits the amount of compression of mating segments 136 of elastomeric columns 134 of the interconnect device 116 along a connection axis 120. Each of the compression stops 166 may be referred to herein as a "mating side stop". The electrical component 112 may be referred to herein as a "first" and/or a "second" electrical component.

Figure 7:
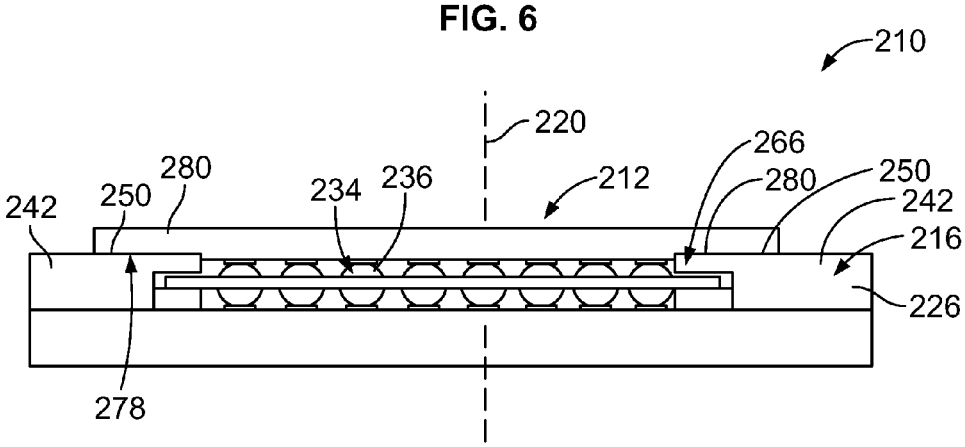
FIG. 7 is a cross-sectional view of yet another exemplary embodiment of an electrical interconnect system.

FIG. 7 illustrates another alternative embodiment of an electrical interconnect system 210 wherein compression stops 266 of an interconnect device 216 engage a flange 280 of an electrical component 212. The interconnect device 216 includes a frame 226 having perimeter segments 242 that include mating side surfaces 250 that provide the compression stops 266. Specifically, the mating side surfaces 250 provide stop surfaces of the compression stops 266. A mating side 278 of the flange 280 of the electrical component 212 is engaged with the mating side surfaces 250 of the perimeter segments 242. Engagement between the flange 280 and the mating side surfaces 250 of the perimeter segments 242 limits the amount of compression of mating segments 236 of elastomeric columns 234 of the interconnect device 216 along a connection axis 220. Each of the compression stops 266 may be referred to herein as a "mating side stop". The electrical component 212 may be referred to herein as a "first" and/or a "second" electrical component.

The embodiments described and/or illustrated herein may provide an interconnect device that is less costly and/or complex.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An interconnect device for electrically connecting first and second electrical components together along a connection axis, said interconnect comprising:

a contact assembly having an insulative carrier and electrical contacts held by the insulative carrier, the insulative carrier comprising opposite mating and mounting sides, the electrical contacts comprising mounting segments that extend along the mounting side of the insulative carrier for mounting to the first electrical component, the electrical contacts comprising mating segments that extend along the mating side of the insulative carrier for mating with the second electrical component, the mating segments being configured to be compressed along the connection axis;

a frame that is configured to be mounted to the first electrical component, the frame comprising a central opening and at least one perimeter segment that defines a boundary of the central opening, the contact assembly being held within the central opening, the at least one perimeter segment comprising a mounting side surface that is configured to face the first electrical component and a mating side surface that is opposite the mounting side surface, the frame comprising a compression stop having a stop surface that is configured to engage the second electrical component to limit an amount of compression of the mating segments along the connection axis, wherein the stop surface is aligned with the mating side surface of the perimeter segment; and wherein the contact assembly is configured to float relative to the frame along a float axis that extends approximately perpendicular to the connection axis.

2. The interconnect device of claim 1, wherein the perimeter segment of the frame comprises the compression stop and the mating side surface of the perimeter segment comprises the stop surface of the compression stop.

3. The interconnect device of claim 1, wherein the compression stop is a mating side stop, the mounting segments of the electrical contacts being configured to be compressed along the connection axis, the frame comprising a mounting side stop that is configured to engage the first electrical component to limit an amount of compression of the mounting segments along the connection axis.

4. The interconnect of device claim 1, wherein the frame comprises a tab that extends from the perimeter segment into the central opening and over an edge segment of the mating side of the insulative carrier, the tab comprising the compression stop.

5. The interconnect device of claim 1, wherein the stop surface of the compression stop is configured to engage a flange of the second electrical component to limit the amount of compression of the mating segments.

6. The interconnect device of claim 1, wherein the frame comprises upper and lower tabs that extend from the perimeter segment into the central opening, the upper and lower tabs extending over the mating and mounting sides, respectively, of the insulative carrier such that the insulative carrier is held by the frame between the upper and lower tabs with a snap-fit connection.

7. The interconnect device of claim 1, wherein at least one of the electrical contacts extends through the insulative carrier and includes a corresponding one of the mating segments and a corresponding one of the mounting segments.

8. The interconnect device of claim 1, wherein at least one of the mounting segments is a discrete electrical contact from the corresponding mating segment that is electrically connected to the corresponding mating segment through at least one intervening electrically conductive structure.

9. The interconnect device of claim 1, wherein at least one of the first electrical component or the second electrical component comprises a circuit board.

10. An interconnect device for electrically connecting first and second electrical components together along a connection axis, said interconnect comprising:

a contact assembly having an insulative carrier and electrical contacts held by the insulative carrier, the insulative carrier comprising opposite mating and mounting sides, the electrical contacts comprising mounting segments that extend along the mounting side of the insulative carrier for mounting to the first electrical component, the electrical contacts comprising mating segments that extend along the mating side of the insulative carrier for mating with the second electrical component; and a frame that is configured to be mounted to the first electrical component, the frame comprising a central opening and a perimeter segment that defines a boundary of the central opening, the frame comprising upper and lower tabs that extend from the perimeter segment into the central opening, the upper tab being spaced apart from the lower tab along the connection axis, at least one of the upper tab or the lower tab being resiliently deflectable, wherein the frame holds the contact assembly within the central opening with a relatively tight fit such that the upper and lower tabs capture an edge segment of the insulative carrier with a snap-fit connection.

11. The interconnect device of claim 10, wherein the perimeter segment comprises at least two perimeter segments, the upper tab comprises at least two upper tabs, and the lower tab comprises at least two lower tabs, each perimeter segment comprising at least one corresponding pair of the upper and lower tabs.

12. The interconnect of device claim 10, wherein at least one of the electrical contacts extends through the insulative carrier and includes a corresponding one of the mating segments and a corresponding one of the mounting segments.

13. The interconnect device of claim 10, wherein at least one of the mounting segments is a discrete electrical contact from the corresponding mating segment that is electrically connected to the corresponding mating segment through at least one intervening electrically conductive structure.

14. The interconnect device of claim 10, wherein at least one of the first electrical component or the second electrical component comprises a circuit board.

15. An interconnect device for electrically connecting first and second electrical components together along a connection axis, said interconnect comprising:

a contact assembly having an insulative carrier and electrical contacts held by the insulative carrier, the insulative carrier comprising opposite mating and mounting sides, the electrical contacts comprising mounting segments that extend along the mounting side of the insulative carrier for mounting to the first electrical component, the electrical contacts comprising mating segments that extend along the mating side of the insulative carrier for mating with the second electrical component, the mating segments being configured to be compressed along the connection axis; and a frame that is configured to be mounted to the first electrical component, the frame comprising a central opening and at least one perimeter segment that defines a boundary of the central opening, the contact assembly being held within the central opening, the frame comprising upper and lower tabs that extend from the perimeter segment into the central opening and over an edge segment of the mating side of the insulative carrier, wherein upper and lower tabs hold the edge with a relatively tight fit, the upper and lower tabs comprising a compression stop having a stop surface that is configured to engage the second electrical component to limit an amount of compression of the mating segments along the connection axis.

16. The interconnect device of claim 15, wherein the frame comprises a lower tab that extends from the perimeter segment into the central opening, the upper tab being spaced apart from the lower tab along the connection axis, at least one of the upper tab and the lower tab being resiliently deflectable, wherein the contact assembly is held by the frame within the central opening such that an edge segment of the insulative carrier is captured between the upper and lower tabs with a snap-fit connection.

17. The interconnect device of claim 15, wherein the perimeter segment comprising a mounting side surface that is configured to face the first electrical component and a mating side surface that is opposite the mounting side surface, the stop surface of the compression stop being aligned with the mating side surface of the perimeter segment.

18. The interconnect device of claim 15, wherein the compression stop is a mating side stop, the frame comprising a lower tab that extends from the perimeter segment into the central opening, the upper tab being spaced apart from the lower tab along the connection axis, the contact assembly being held by the frame within the central opening such that an edge segment of the insulative carrier is captured between the upper and lower tabs, the mounting segments of the electrical contacts being configured to be compressed along the connection axis, the lower tab comprising a mounting side stop that is configured to engage the first electrical component to limit an amount of compression of the mounting segments along the connection axis.

19. The interconnect of device claim 15, wherein at least one of the electrical contacts extends through the insulative carrier and includes a corresponding one of the mating segments and a corresponding one of the mounting segments.

20. The interconnect device of claim 15, wherein at least one of the mounting segments is a discrete electrical contact from the corresponding mating segment that is electrically connected to the corresponding mating segment through at least one intervening electrically conductive structure.

* * * * *